US005445667A

United States Patent [19]

Malmström

[11] Patent Number: 5,445,667

[45] Date of Patent: Aug. 29, 1995

[54] METHOD FOR REDUCING MATERIAL CONTAINING METAL OXIDE IN SOLID PHASE

[75] Inventor: Rolf Malmström, Helsinki, Finland

[73] Assignee: A. Ahlstrom Corporation, Noormarkku, Finland

[21] Appl. No.: 256,575

[22] PCT Filed: Jan. 21, 1993

[86] PCT No.: PCT/FI93/00020

§ 371 Date: Jul. 18, 1994

§ 102(e) Date: Jul. 18, 1994

[87] PCT Pub. No.: WO93/15232

PCT Pub. Date: Aug. 5, 1993

[30] Foreign Application Priority Data

Jan. 24, 1992 [FI] Finland ..... 920310

[51] Int. Cl.[6] ..... C21B 13/02

[52] U.S. Cl. ..... 75/448; 75/447

[58] Field of Search ..... 75/10.27, 10.38, 447, 75/448

[56] References Cited

U.S. PATENT DOCUMENTS

| | | | |
|---|---|---|---|
| 2,894,831 | 7/1959 | Old | 75/10.38 |
| 2,978,315 | 4/1961 | Schenck | 75/10.27 |

FOREIGN PATENT DOCUMENTS

| | | |
|---|---|---|
| 0022098 | 7/1981 | European Pat. Off. . |
| 2510116 | 11/1975 | Germany . |
| 3629589 | 3/1988 | Germany . |
| 1506170 | 4/1978 | United Kingdom . |
| WO80/02652 | 12/1980 | WIPO . |

*Primary Examiner*—Peter D. Rosenberg
*Attorney, Agent, or Firm*—Nixon & Vanderhye

[57] ABSTRACT

A method of reducing material containing metal oxide in a circulating fluidized bed, in which coal in excess and air is introduced into the fluidization chamber so as to maintain a temperature of >850° C. in the chamber. Bed material which has been separated from the flue gases is conveyed through a carbidization chamber in a recirculation system at a temperature of <850° C. to the lower part of the fluidization chamber. Conditions favorable for formation of carbide are maintained in the carbidization chamber.

20 Claims, 1 Drawing Sheet

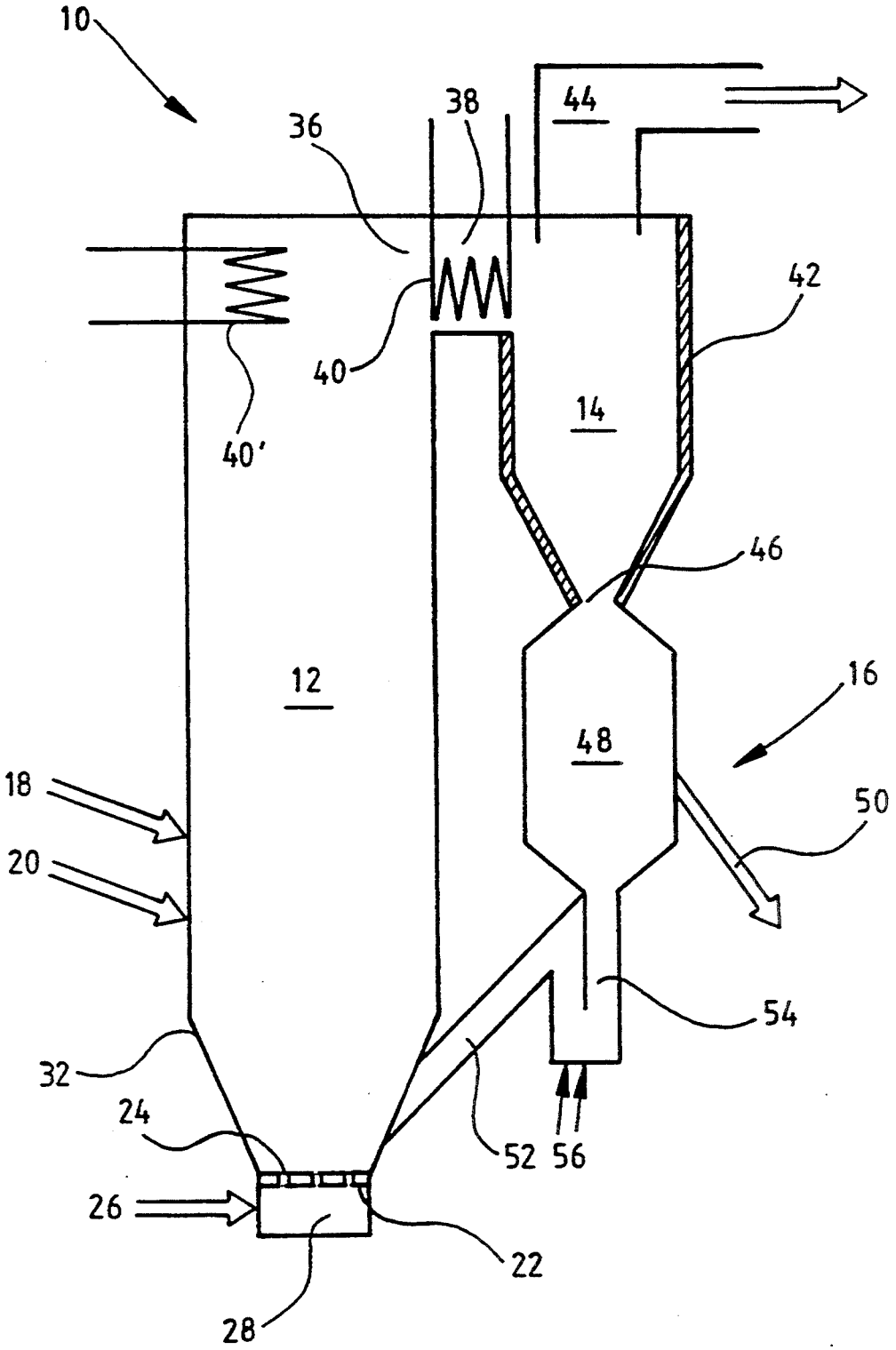
10
36
38
44
42
40
40'
14
46
12
16
48
18
50
20
54
32
24
52
56
26
22
28

METHOD FOR REDUCING MATERIAL CONTAINING METAL OXIDE IN SOLID PHASE

BACKGROUND AND SUMMARY OF THE INVENTION

The present invention relates to a method for reducing material containing metal oxide in solid phase in a circulating fluidized bed reactor.

The present invention is particularly suited for reduction of iron ore to metallic iron with carbon, i.e. with a mixture of CO and $CO_2$. The invention can advantageously be used for pre-reducing iron ore before the smelting stage in a direct smelting reduction process.

The reduction of iron oxide is an endothermic process and requires supply of energy. In a reduction process in which coal or coke in solid form is supplied, the energy required for the reaction can easily be supplied by partial combustion of the coal. Depending on the temperature, a certain content of $CO_2$ in the gas can be permitted, preferably however so that the $CO_2/CO+CO_2$ ratio does not exceed 0.2. This implies a certain degree of oxidation of the coal or the coke beyond the CO stage, but requires then preheating of the ore concentrate as well as the air, if air and not oxygen is used.

The reaction kinetics of the reduction $$Fe_2O_3 \rightarrow FeO$$

is relatively unfavourable at the low temperatures normally prevaling in fluidized bed reactors. At temperatures of about 800° C., reaction times of several minutes, possibly tens of minutes, are required, depending on the particle size and the desired degree of reduction. The subsequent reaction according to $$FeO+CO \rightarrow Fe+CO_2$$

to metallic iron is effected at a temperature of above 700° C. at an appropriate gas composition.

The reduction of iron ore to metallic iron in the fluidized bed is impeded by the tendency of the particles in the bed to sinter. Higher temperatures, which would give higher, and therefore more favourable, reaction kinetics for the reduction process, lead to a higher tendency to sinter. The risk of sintering has considerably limited the use of fluidized bed technique for pre-reduction of iron ore.

Sintering is believed to be caused in part by the sticky iron ore particles in which the iron is completely or partly in metallic form. FeO appears as a molten layer on the surface of the pre-reduced ore, which causes sintering of small particles into larger particles and aggregates. Sintering of the particles in the reactor renders it diffucult or impossible to bring about fluidization in the reactor.

Sintering can, in addition to a molten iron layer on the particles, be caused by crystallization of metallic iron as dendrites on the ore particles, whereby particles are formed that very easily become attached to and grow into each other. Sintering is also believed to be caused by a particularly active layer of metallic iron surrounding the larger ore particles, the active layer having a certain adhesion force and attracting smaller particles.

Sintering can be avoided by carrying out the reduction at very low temperatures, which however would result in unfavourable reaction kinetics and, at lower temperatures, in formation of carbides instead of metallic iron.

To avoid sintering in reduction in a fluidised bed at higher temperatures, coal or coke has been mixed in, which has been believed to prevent sintering, either in form of indvidual particles in the bed or in form of a protecting coke layer on the bed particles. Injection of oil in the hot bed has also been believed to contribute to the formation of a layer of coke on the iron particles, which would prevent sintering.

Addition of coke has, however, proved to cause segregation, particularly in conventional fluidized beds, so that the iron particles concentrate in the lower part of the reactor and the coke particles in the upper part of the reactor. This has had a negative effect on the reduction process.

It is an object of the present invention to provide a method for reducing material containing metal oxide in which the above mentioned drawbacks, i.e. segregation and sintering, can be avoided.

The present invention has in a surprisingly simple manner solved the problems of the reduction processes described earlier by carrying out the reduction in an circulating fluidized bed (CFB) reactor so that

- coal or coke in excess, for reduction of the material containing metal oxide, and gas containing oxygen gas is introduced in the fluidization chamber of the reactor so as to bring about generation of heat for maintaining a temperature of >850° C. in the fluidization chamber;
- bed material containing pre-reduced material containing metal oxide and coke is exhausted with the flue gases through a gas outlet in the upper part of the fluidization chamber and conveyed to a particle separator and cooled to a temperature equal to or <850° C.;
- the bed material which has been separated from the flue gases in the particle separator is returned to the lower part of the fluidization chamber via a carbidization chamber in which conditions favourable for formation of carbide are maintained.

According to the method of the invention, by supplying coal or coke in excess and a certain amount of gas containing oxygen gas to a CFB reactor, heat can be generated and a high temperature be maintained in the fluidization chamber. The gas containing oxygen gas can consist of air preheated to a temperature of >800° C., preferably >1000° C., oxygen-enriched air or pure oxygen gas. This results in high level reaction kinetics, whereby, with an appropriate $CO_2/CO+CO_2$ ratio, metallic iron is produced according to the reaction $$FeO+CO \rightarrow Fe+CO_2.$$

Lowering the $CO_2/CO+CO_2$ ratio results in reduction of iron oxide on the surface of the particles of the ore concentrate according to the carbidization reaction $$FeO+4C \rightarrow Fe_3C+3CO$$

which is favorable as regards the sintering. The formation of iron carbides takes precedence of the formation of metallic iron. This is also promoted by lower temperatures.

According to the invention, the above mentioned carbidization reaction is used in the recirculation system of the CFB reactor. In the return pipe and the carbidization chamber pre-reduced iron ore and coke which has been separated from the flue gases of the reactor will be in an unfluidized state, the gas atmosphere which surrounds the particles consisting mainly of pure CO, the $CO_2/CO+CO_2$ ratio consequently being very small. The CO atmosphere which surrounds the particles is obtained by the reduction reactions which continue in the recycled material in the recirculation system. As the temperature of the material at the same time decreases some tens of degrees (possibly 100 degrees), either by cooling or only because the endothermic but not the exothermic reactions continue, the reduction products of in the recirculation system of the CFB reactor will consist of $Fe_3C$ in accordance with the reaction formula above. A temperature of 800° to 850° C. is in most cases suitable. The dwell time in the reactor can be influenced by modifying the design of the return pipe.

A formation of carbide on the surface of the partly reduced ore concentrate will prevent sintering of the material in the recirculation part as well as in the fluidization part of the CFB reactor. The invention renders it possible to prevent sintering of the particles in the bed without causing detrimental effects on the reaction kinetics of the reduction process in the fluidization chamber.

By means of the method of the present invention, the undesired sintering in a fluidized bed reactor can be brought under control, irrespective of the form of the metallic iron produced by the reduction, be it pure Fe or $Fe_3C$. If this process is used as a primary stage in a direct smelting process, possible carbides in the reduced material will have a positive effect on the whole process.

The invention brings about inter alia the following advantages:

- high reaction kinetics for the reduction, while the reduction process in a CFB reactor can be effected at relatively high temperatures, and
- formation of carbide which prevents sintering brought about by an decrease of the temperature in the recirculation step, by direct cooling before, after or in the particle separator or brought about by the endothermic reduction reactions.

Pre-reduction of iron oxide requires a certain minimum of reduction potential of the reducing gas. For instance in a reduction process according to the invention in a reactor with a circulating fluidized bed having a particle size of up to 1 mm and a temperature of 900° C., a $CO_2/CO+CO_2$ ratio of between 0.2 and 0.3 can give a reaction time of some minutes, e.g. 10 minutes, and an acceptable degree of metallization of iron ore.

The invention will be further described with reference to the accompanying drawing showing an apparatus for carrying out the method according to the invention.

BRIEF DESCRIPTION OF THE DRAWING

FIG.1 is a side schematic view illustrating exemplary apparatus for practicing the method according to the present invention.

DETAILED DESCRIPTION OF THE DRAWING

The apparatus shown in the FIG. 1 comprises a reactor 10 having a circulating bed. The reactor consists of a fluidization chamber 12, a particle separator 14, which in this case is a cyclone, and a recirculation system 16 for the particles separated in the cyclone.

The fluidization chamber has a supply pipe 18 for material containing metal oxide and a supply pipe 20 for coal or coke. The bottom plate 22 of the fluidization chamber is provided with openings 24 or nozzles for feeding preheated air 26 from a chamber 28 for fluidizing the bed particles and bringing about generation of heat with coal or coke.

An outlet opening 36 for flue gases disposed in the upper part of the fluidization chamber is connected to an outlet channel 38 which connects the fluidization chamber with the cyclone. Heat transfer surfaces 40 and 40' for cooling the gas suspension exiting from the fluidization chamber are disposed in outlet channel 38 and possibly also in the upper part of the fluidization chamber. Cyclone 14 can, alternatively or additionally, be provided with cooled surfaces 42. The coolant can consist of air or water. The air which is needed in the process can for instance advantageously be preheated on the heat transfer surfaces. Cooling can also be accomplished by supplying cooled or not preheated coal or coke to the bed.

A gas outlet pipe 44 is disposed in the upper part of the cyclone. The lower part of the cyclone has an outlet opening 46 for separated particles. A carbidization chamber 48 is connected to the cyclone via the outlet opening. The chamber has an outlet 50 for solid particles, through with finished reduced material can be withdrawn. Material can also, if desired, be withdrawn directly from the fluidization chamber. The lower part of chamber 48 is connected to a return pipe 52, which is connected to the lower part of the fluidization chamber. A part of the return pipe consists of a gas lock 54 which prevents gases from escaping from the fluidization chamber to the cyclone through the pipe.

Iron ore was, according to the invention, reduced in the apparatus shown in the figure as follows: Iron ore having a particle size of up to 1 mm was introduced in the fluidization chamber through supply pipe 18. Coke in excess was supplied through supply pipe 20, whereby a degree of reduction corresponding to a $CO_2/CO+CO_2$ ratio of between 0.2 and 0,3 was reached.

The fluidizing air 26 consisted of preheated air (e.g. heated to >1000° C.) which was supplied so that a substantial portion of the solid particles of the fluidized bed was discharged from the fluidization chamber with the flue gases. The preheated air also kept up the combustion of the supplied coke so that a temperature of 900° C. was maintained in the fluidization chamber. The iron ore was pre-reduced according to the reaction $$FeO+CO \rightarrow Fe+CO_2$$

in the fluidization chamber to an acceptable degree of metallization.

Cyclone 14 was provided with cooling surfaces 42, which lowered the temperature of the particles containing metal oxide separated in the cyclone 50° to 100° C. The separated particles, which contained inter alia pre-reduced ore concentrate, Fe and FeO, and coke was introduced in chamber 48 of the recirculation system. The temperature in the chamber was 800° C.

The particles were conveyed relatively slowly downwards trough the chamber, whereby the pre-reduced ore concentrate particles reacted in a reducing atmosphere with coke particles forming iron carbide. The iron carbide formed a thin layer on the particles, which later served as a protection preventing particles from sintering in the recirculation system as well as in the fluidization chamber. The end product could be withdrawn from chamber 48 trough outlet 50. The dwell time of the iron ore particles in the reactor was about 5 to 15 minutes.

The invention is not limited to the embodiment described above, but many modifications may be made thereof within the scope of the following claims. Also other materials containing metal oxide than the material containing iron oxide described in the example can be treated according to the method of the invention.

We claim:

1. A method of reducing material containing metal oxide in solid phase in a circulating fluidized bed reactor having a fluidization chamber with an upper part and a lower part, comprising the steps of:

(a) introducing oxygen-containing gas, fluidizing gas, material containing metal oxide, and an excess of coal or coke for the reduction of the material containing metal oxide, into the fluidized bed reactor fluidization chamber so as to generate heat to maintain a temperature of greater than 850° C. in the fluidization chamber;

(b) exhausting flue gases with entrained pre-reduced material particles containing metal oxide and coke through a gas outlet in the upper part of the fluidization chamber;

(c) separating the particles from the exhausted flue gases;

(d) exposing the separated particles from step (c) to conditions favorable for the formation of carbide, so that carbide does form;

(e) prior to step (d), cooling the particles to a temperature equal to or less than 850° C.; and (f) after step (d), returning the separated particles, with formed carbide, to the lower part of the fluidization chamber.

2. A method as recited in claim 1 wherein step (a) is practiced to maintain a temperature of greater than 900° C. in the fluidization temperature.

3. A method as recited in claim 2 wherein step (e) is practiced both prior to step (c), and during the practice of step (c).

4. A method as recited in claim 2 wherein step (a) is practiced with the metal oxide consisting essentially of iron oxide.

5. A method as recited in claim 4 wherein step (d) is practiced at a temperature of between 800°–850° C.

6. A method as recited in claim 5 wherein step (d) is practiced in a chamber having a gas atmosphere comprising substantially pure CO.

7. A method as recited in claim 1 wherein step (d) is practiced at a temperature of between 800°–850° C.

8. A method as recited in claim 7 wherein step (d) is practiced in a chamber having a gas atmosphere primarily comprising CO.

9. A method as recited in claim 1 wherein step (d) is practiced in a chamber having a gas atmosphere comprising substantially pure CO.

10. A method as recited in claim 1 wherein step (c) is practiced in a cyclone separator, and wherein step (e) is practiced at least in part during the practice of step (c).

11. A method as recited in claim 1 wherein step (e) is practiced at least in part prior to step (c).

12. A method as recited in claim 1 wherein step (a) is practiced by introducing the fluidizing gas at a temperature of greater than 1000° C., and includes oxygen containing gas.

13. A method as recited in claim 1 wherein step (d) is practiced with the particles in an unfiuidized state.

14. A method as recited in claim 1 wherein step (d) is practiced in a carbidization chamber; and comprising the further step of positively precluding the backflow of gas from the fluidization chamber to the carbidization chamber.

15. A method as recited in claim 1 wherein the degree of carbidization in step (d) is controlled by adjusting the dwell time of particles during the practice of all of steps (a) through (f).

16. A method as recited in claim 15 wherein steps (a) through (f) are practiced so that the dwell time of material containing metal oxide is less than about 15 minutes.

17. A method as recited in claim 13 wherein the temperature during the practice of step (d) is between 800°–850° C.

18. A method as recited in claim 13 wherein step (d) is practiced in a chamber having a gas atmosphere primarily comprising CO.

19. A method as recited in claim 1 wherein step (a) is practiced with the metal oxide consisting essentially of iron oxide.

20. A method as recited in claim 1 wherein steps (a) through (f) are practiced so that the dwell time of material containing metal oxide is less than about 15 minutes.

* * * * *